US007592559B2

(12) United States Patent
Blake, III

(10) Patent No.: US 7,592,559 B2
(45) Date of Patent: Sep. 22, 2009

(54) BEZEL AND ACTUATOR

(75) Inventor: Thomas E. Blake, III, South Lyon, MI (US)

(73) Assignee: TRW Automotive U.S. LLC, Livonia, MI (US)

( * ) Notice: Subject to any disclaimer, the term of this patent is extended or adjusted under 35 U.S.C. 154(b) by 445 days.

(21) Appl. No.: 11/116,747

(22) Filed: Apr. 28, 2005

(65) Prior Publication Data

US 2006/0243574 A1 Nov. 2, 2006

(51) Int. Cl.
*H01H 13/04* (2006.01)
*H01H 13/08* (2006.01)
*H01H 13/10* (2006.01)
*H01H 19/04* (2006.01)

(52) U.S. Cl. ..... 200/296; 200/341

(58) Field of Classification Search ..... 200/296
See application file for complete search history.

(56) References Cited

U.S. PATENT DOCUMENTS 4,546,695 A 10/1985 Ouchi et al.
5,298,215 A 3/1994 Krause
5,715,782 A 2/1998 Elder
6,096,985 A * 8/2000 Ritter et al. ..... 200/6 A
6,225,579 B1 * 5/2001 Ritter et al. ..... 200/6 A
6,333,478 B1 * 12/2001 Altmann ..... 200/520
6,335,499 B1 * 1/2002 Kokubu et al. ..... 200/341
6,416,700 B1 7/2002 Hatagishi et al.
6,900,404 B2 * 5/2005 Searle et al. ..... 200/341
2005/0199476 A1 * 9/2005 Kim ..... 200/5 R
2006/0180447 A1 * 8/2006 Korultay et al. ..... 200/329

OTHER PUBLICATIONS

Co-pending U.S. Appl. Ser. No. 10/914,878, filed Aug. 25, 2004 for Plastic Clamp and Method of Manufacturing the Same.
Co-pending U.S. Appl. No. 10/909,827, filed Aug. 2, 2004 for Vehicle Latch and Method of Manufacturing the Same.
Co-pending U.S. Appl. No. 10/818,254, filed Apr. 4, 2004 for Pressure Relief Valve and Method of Forming the Same.

* cited by examiner

*Primary Examiner*—Elvin G Enad
*Assistant Examiner*—Lheiren Mae A Anglo
(74) *Attorney, Agent, or Firm*—Tarolli, Sundheim, Covell & Tummino LLP

(57) ABSTRACT

An improved actuator (24) and bezel (22) are assembled in a mold (140). The actuator (24) is linearly movable relative to the bezel (22). A guide surface (44 or 76-80) on the actuator (24) is formed by being molded against a guide surface (38 or 70-74) on the actuator (24). The bezel (22) is molded of a first plastic material in a mold (140). While the bezel (22) is still in the mold (140), the actuator (24) is molded in an opening in the bezel and is formed of a different plastic material than the bezel.

12 Claims, 6 Drawing Sheets

BEZEL AND ACTUATOR

BACKGROUND OF THE INVENTION

The present invention relates to a bezel and actuator and to the method by which they are formed.

A known automotive vehicle instrument panel has actuators which are movable relative to a bezel to effect operation of electrical equipment associated with the vehicle. One or more of the actuators may be manually moved to effect operation of vehicle lights, heater, or air conditioner. Known bezel and actuator assemblies used in vehicles have interfaces with close tolerances.

In spite of these close tolerances, there have been complaints about the actuators having a loose feel and about noise due to rattle between the actuator and the is bezel. In addition, assembly of the actuators and the bezel is difficult. With some vehicles, there may be as many as fourteen actuators associated with a bezel.

Known assemblies of plastic, that is, polymeric materials, have had one part pivotal relative to another part. In order to facilitate construction of these parts, it has previously been suggested that the parts may be formed using in-mold assembly technology. This may be done in the manner disclosed in U.S. patent application Ser. No. 10/819,877 filed by Lewis and Blake on Apr. 7, 2004 and entitled A cabinet catch for use in a cabinet latch assembly and a method for making the catch.

SUMMARY OF THE INVENTION

The present invention relates to a new and improved bezel and actuator assembly and the method by which it is manufactured. The bezel and actuator assembly may include an actuator having a guide surface and a bezel having a guide surface which engages the guide surface on the actuator. One of the guide surfaces is formed by being molded against the other guide surface. The guide surfaces cooperate to guide movement of the actuator along a linear path relative to the bezel.

BRIEF DESCRIPTION OF THE DRAWINGS

The foregoing and other features of the present invention will become more apparent upon a consideration of the following description taken in connection with the accompanying drawings wherein.

DESCRIPTION OF SPECIFIC PREFERRED EMBODIMENTS OF THE INVENTION

Figure 1:
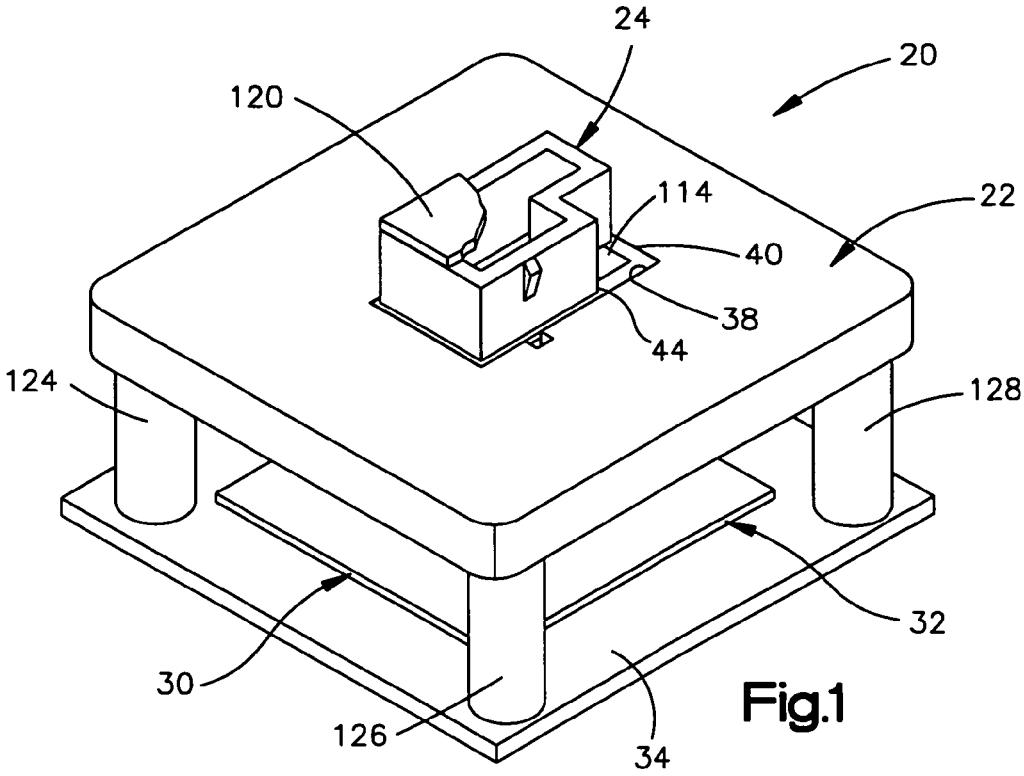
FIG. 1 is a schematic, partially broken away, pictorial illustration of a bezel and actuator assembly which is manufactured and operated in accordance with the present invention.

A bezel and actuator assembly 20 constructed in accordance with the present invention is illustrated schematically in FIG. 1. The bezel and actuator assembly 20 includes a bezel 22 and an actuator 24 (see FIGS. 1 and 2). The actuator 24 is manually movable in a downward (as viewed in FIGS. 1 and 2) direction along a linear path from the initial or unactuated position of FIG. 1 to an actuated position.

Downward movement of the actuator 24 to the actuated position effects operation of switch assemblies 30 and 32 (FIG. 2) from an unactuated condition to an actuated condition. The switch assemblies are disposed on a printed circuit board 34. Upon being manually released, the actuator 24 moves upward along the linear path back to the unactuated position shown in FIG. 1. As this occurs, the switch assemblies 30 and 32 operate from the actuated condition to the unactuated condition.

Linear movement of the actuator 24 between its initial or unactuated position and its actuated position is guided by the bezel 22. The bezel 22 has a guide surface 38 (FIG. 2) which engages a guide surface 40 formed on a collar 44 (FIG. 2) which extends around the actuator 24. When the actuator 24 is in the unactuated position of FIG. 1, the guide surface 40 on the actuator 24 engages the guide surface 38 on the bezel 22 to hold the actuator 24 against sidewise movement and rattling.

The bezel guide surface 38 and actuator guide surface 40 guide initial movement of the actuator from its unactuated position toward its actuated position. Similarly, the bezel guide surface 38 and actuator guide surface 40 guide final upward movement (as viewed in FIGS. 1 and 2) of the actuator 24 back to its unactuated position under the influence of springs in the switch assemblies 30 and 32.

In order to facilitate formation and assembly of the actuator 24 and bezel 22, they are made utilizing in-mold assembly technology. By using in-mold assembly technology, the actuator guide surface 40 is accurately molded, that is, shaped, by engagement with the bezel guide surface 38. This results in consistent tolerances at an interfaces between the bezel guide surface 38 and actuator guide surface 40 being very tight (+/0.05 mm) to eliminate objectionable movement and noise due to rattle when the actuator 24 is in the unactuated position of FIG. 1.

In addition, the use of in-mold assembly technology for formation of the bezel 22 and actuator 24 facilitates assembling of the actuator and bezel. This is because the bezel 22 and actuator 24 are molded in an assembled condition. To enable the actuator 24 to be molded against the bezel 22, the bezel is made of a plastic (polymeric) material which melts at a higher temperature than the plastic (polymeric) material of the actuator. Even though the actuator 24 is molded against the bezel 22, bonds are not formed between the plastic material of the bezel and the plastic material of the actuator during molding.

If desired, the bezel 22 may be molded against the actuator 24. If this is done, the bezel 22 would be made of a plastic which melts at a lower temperature than the plastic material of the actuator 24.

The bezel guide surface 38 and actuator guide surface 40 cooperate to hold the actuator 24 against movement relative to the bezel 22 when the actuator is in the initial or unactuated position of FIG. 1. In addition, the bezel guide surface 38 and actuator guide surface 40 cooperate to guide initial relative movement between the actuator 24 and bezel 22 upon manual actuation of the actuator. However, the bezel guide surface 38 and actuator guide surface 40 have relatively short axial extents and therefore are effective to guide only a relatively small portion of movement between the actuator 24 and bezel 22 during manual actuation of the actuator.

Figure 3:
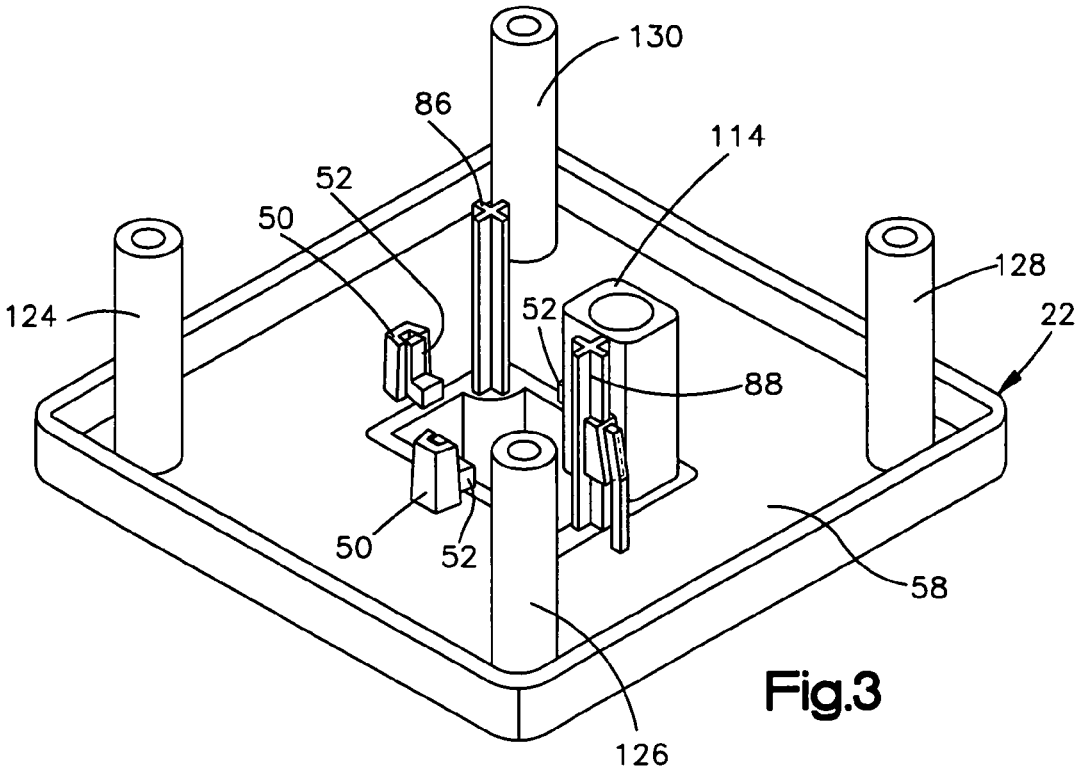
FIG. 3 is a perspective view, with parts omitted, of the bottom of FIG. 1.
Figure 4:
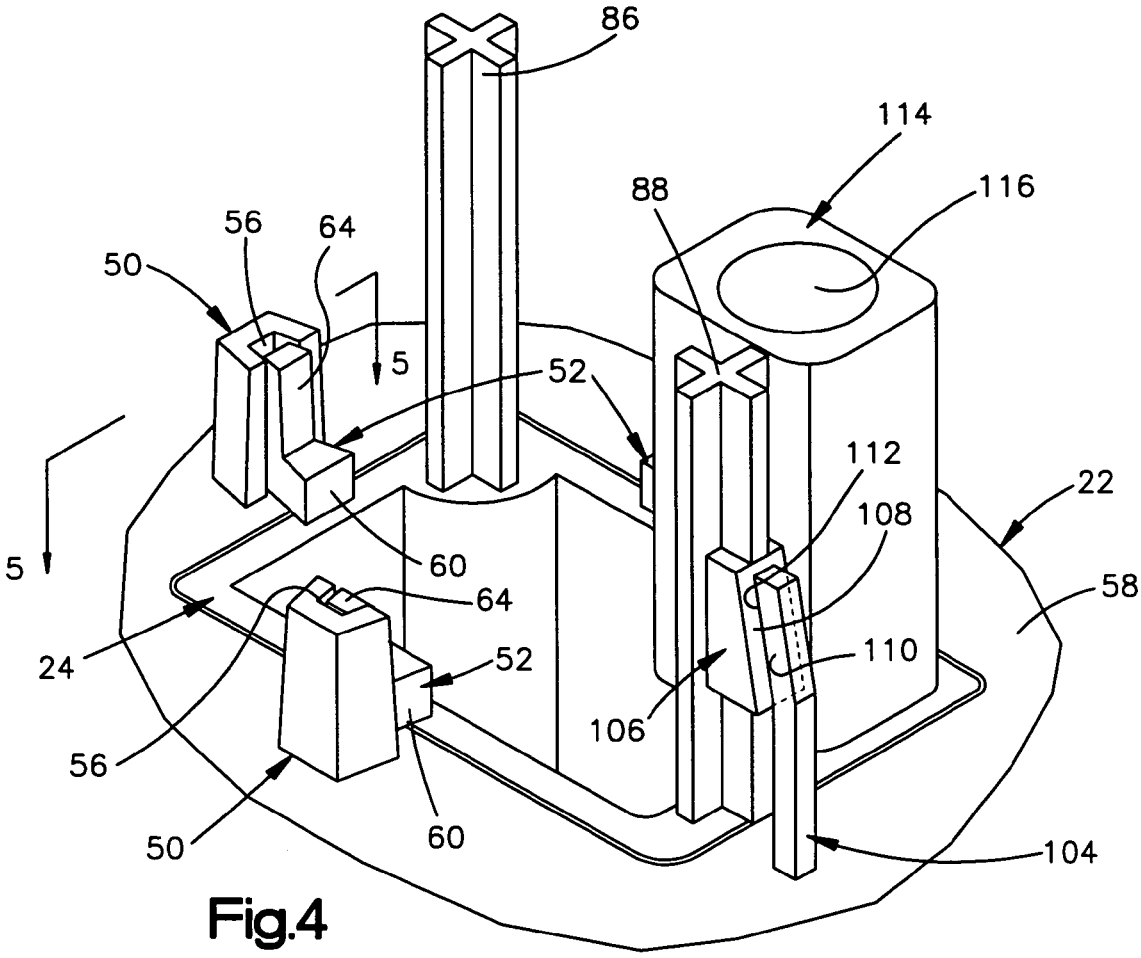
FIG. 4 is an enlarged schematic pictorial illustration of a portion of FIG. 3.

Movement of the actuator 24 through an entire operating stroke relative to the bezel 22 is guided by cooperation between a plurality of bezel guide posts 50 (FIGS. 3 and 4) and a plurality of actuator guide members 52. The bezel guide posts 50 are integrally molded as one piece with the remainder of the bezel 22. The actuator guide members 52 are integrally molded as one piece with the remainder of the actuator 24. Although only two bezel guide posts 50 are illustrated in FIGS. 3 and 4, it should be understood that there are three guide posts which cooperate with three guide members 52.

During movement of the actuator 24 relative to the bezel 22, the actuator guide members 52 slide along linear guide channels 56 (FIGS. 4 and 5) formed by the bezel guide posts 50. The guide channels 56 have longitudinal central axes which extend perpendicular to a flat bottom surface 58 of the bezel 22. The central axes of the guide channels extend parallel to the linear path of movement of the actuator 24.

Figure 5:
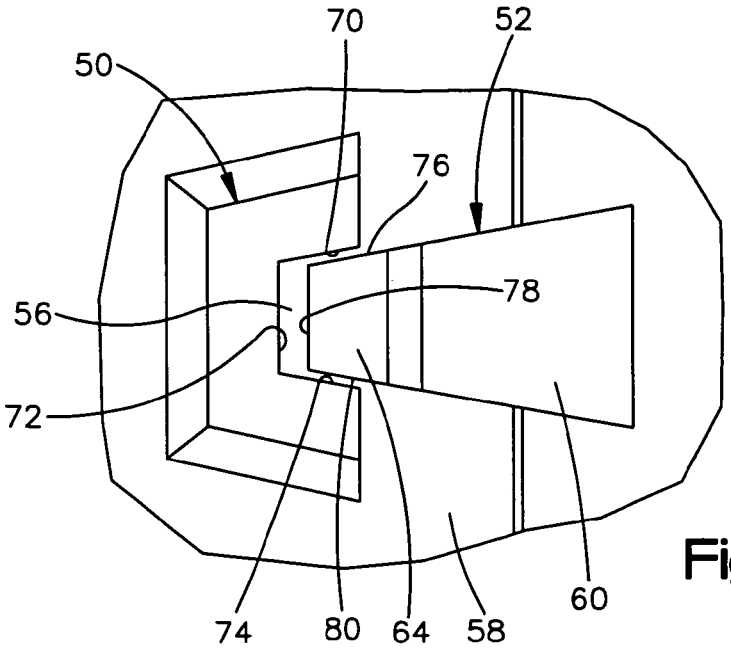
FIG. 5 is an enlarged top plan view, taken generally along the line 5-5 of FIG. 4, illustrating a guide member which forms part of the actuator and a guide post which forms part of the bezel.

A portion of each of the guide members 52 remains in an associated guide channel 56 throughout movement of the actuator 24 between the initial or unactuated position and the actuated position. Thus, throughout linear movement of the actuator 24 from the initial or unactuated position to the actuated position, the guide members 52 move along the parallel guide channels 56 (FIGS. 4 and 5). Similarly, throughout linear movement of the actuator 24 from its actuated position back to its initial or unactuated position, the guide members 52 move along the guide channels 56.

End portions 60 of the guide members 52 engage the flat bottom surface 58 of the bezel 22 when the actuator 24 is in the unactuated position. The end portions 60 of the guide members 52 are pressed firmly against the bottom surface 58 of the bezel 22 by springs in the switch assemblies 30 and 32 to limit upward (as viewed in FIG. 1) movement of the actuator 24 when the actuator is in the unactuated position.

The guide members 52 (FIGS. 4 and 5) are molded against guide channels in the guide posts 50 during the in-mold assembly process in which the actuator 24 is molded in the bezel 22. This results in the guide channel 56 having guide surfaces 70, 72 and 74 (FIG. 5) which are parallel to guide surfaces 76, 78 and 80 on the guide members 52. There is a small amount (+/0.05 mm) of uniform clearance between the guide surfaces 70, 72 and 74 on the guide posts 50 and the guide surfaces 76, 78 and 80. This consistent clearance is formed by shrinkage of the plastic material of the bezel 22 during molding of the bezel. The tight and consistent clearance between the bezel guide surfaces 70, 72 and 74 and the actuator guide surfaces 76, 78 and 80 provides the actuator 24 with a stable feel as it is moved between its unactuated and actuated positions.

The plastic (polymeric) material of the guide members 52 is molded against the plastic (polymeric) material of the guide posts 50. As the plastic material of the actuator 24 cools, the guide surfaces 76, 78 and 80 on the guide members 52 move away from the guide surfaces 70, 72 and 74 on the guide posts 50 to form clearance spaces in the manner illustrated schematically in FIG. 5. The uniform clearance spaces between the bezel guide surfaces 70-74 and the actuator guide surfaces 76-80 is approximately 0.05 mm.

It should be understood that FIG. 5 is merely a schematic illustration of the clearance spaces which are formed by shrinkage of the polymeric material of the actuator 24 during molding. The actual clearance which is formed may be different than is illustrated schematically in FIG. 5.

As was previously mentioned, the bezel 22 may be molded against the actuator 24. If this is done, the guide surfaces 70-74 (FIG. 5) on the guide posts 50 would be molded against the guide surfaces 76-80 on the guide members 52. As a result of shrinkage of the plastic (polymeric) material of the actuator 24, small uniform clearance spaces of about 0.05 mm would be formed between the guide surfaces 76-80 on the guide members 52 and the guide surfaces 70-74 on the guide posts 50.

A pair of actuator legs 86 and 88 (FIGS. 3 and 4) extend from the lower (as viewed in FIG. 1) side of the actuator 24. The actuator legs 86 and 88 are engageable with the switch assemblies 30 and 32 (FIG. 2) to actuate the switch assemblies upon movement of the actuator 24 from the unactuated position of FIG. 1 to the actuated position. The actuator legs 86 and 88 extend parallel to the guide members 52 and to the linear path of movement of the actuator 24.

Figure 2:
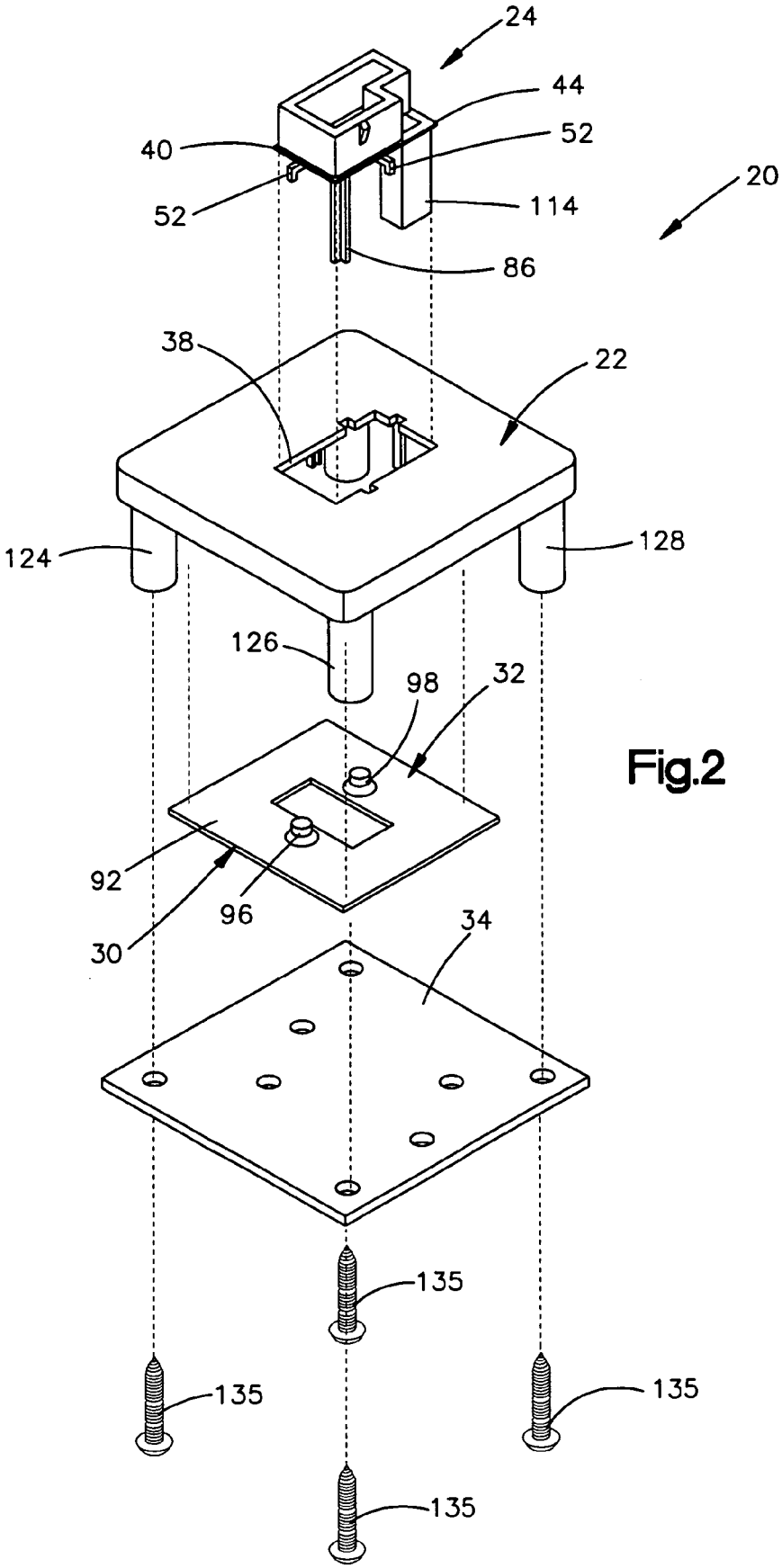
FIG. 2 is an exploded schematic pictorial illustration of components of the bezel and actuator assembly of FIG. 1.

The actuator leg 86 is engageable with the switch assembly 30 (FIG. 2) to actuate the switch assembly. Similarly, the actuator leg 88 (FIG. 4) is engageable with the switch assembly 32 (FIG. 2). The switch assemblies 30 and 32 include a generally rectangular silicon membrane 92 (FIG. 2) having a central opening. The membrane 92 is mounted on the circuit board 34.

Known spring assemblies 96 and 98 are mounted on the membranes 92 and 94. The spring assembly 96 is aligned with the actuator leg 86 (FIG. 4) on the actuator 24. Similarly, the spring assembly 98 is aligned with the actuator leg 88 on the actuator 24 (FIGS. 2 and 4). The spring assemblies 96 and 98 have resiliently deflectable components which are deflected by force transmitted through the actuator legs 86 and 88. Spring forces applied to the actuator legs 86 and 88 by the spring assemblies 96 and 98 are effective to move the actuator 24 from its actuated position back to its unactuated position.

The switches disposed beneath the membrane 92 are electrically connected with an apparatus to be operated in response to manual actuation of the actuator 24. For example, the switches may be connected with lights, heating, air conditioning, or ventilation equipment in a vehicle. However, it should be understood that the bezel and actuator assembly 20 may be utilized in environments other than in association with a vehicle. For example, the bezel and actuator assembly 20 may be utilized in machine controls or in electronic devices. As a further example, each of the keys on a computer keyboard may be formed by an actuator 24 with an upper side of the keyboard being formed by the bezel 22.

Although it is preferred to utilize known spring assemblies 96 and 98 in association with the actuator 24, it is contemplated that other known types of spring assemblies and or switches may be utilized in association with the actuator if desired. For example, known maintained, alternate action, or momentary switches may be utilized in association with the actuator 24.

A flexible finger 104 (FIG. 4) cooperates with a cam stop 106 on the actuator leg 88 to limit the extent of downward (as viewed in FIGS. 1 and 2) movement of the actuator 24 relative to the bezel 22 under the influence of gravity prior to connection of the bezel and actuator assembly 20 with the printed circuit board 34 and switch assemblies 30 and 32 (FIGS. 1 and 2). When the actuator 24 has moved downward (as viewed in FIG. 1) under the influence of gravity through a small predetermined distance relative to the bezel 62, a ramp surface 108 (FIG. 4) on the cam stop 106 engages the flexible finger 104. The flexible finger 104 is then effective to stop downward movement of the actuator 24. This effectively traps the actuator 24 to prevent disengagement of the actuator from the bezel 22 under the influence of gravity prior to connection of the bezel with the printed circuit board 34 and switch assemblies 30 and 32.

Once the bezel 22 has been connected with the printed circuit board 34 in the manner illustrated in FIG. 1, downward movement of the actuator 24 to operate the switches 30 and 32 (FIG. 2) is effective to press the ramp surface 108 on the cam stop 106 against the flexible finger 104 and to the deflect the flexible finger. This enables the actuator 24 to continue its downward (as viewed in FIG. 1) movement to actuate the dome switches 96 and 98.

During this continued downward movement, the flexible finger 104 is resiliently deflected toward the right (as viewed in FIG. 4) by the cam stop 106. This results in force being applied against actuator leg 88. The force applied against the actuator leg 88 by the flexible finger 104 is effective to stabilize the actuator 24 against wobbling or sideward movement.

The ramp surface 108 on the actuator leg 88 extends at an angle of five (5) to seven (7) degrees relative to the linear path of movement of the actuator 24 and to the central axis of the actuator leg 88. The flexible finger 104 has an end portion 110 with a side surface 112 which extends parallel to the ramp surface 108. When, prior to assembly with the circuit board 34 and switches 30 and 32, the actuator 24 has moved downward (as viewed in FIG. 1) through a small distance relative to the bezel 22, the ramp surface 108 on the actuator leg 88 is in flat abutting engagement with the side surface 112 on the flexible finger 104.

When the actuator 24 is being injection molded in the opening formed by the bezel guide surface 38, plastic material which is to form the ramp surface 108 of the cam stop 106 is in engagement with the flexible finger 104. When the plastic material of the cam stop 106 cools, the plastic material shrinks. This shrinkage results in the formation of the initial space of approximately 0.05 mm between the ramp surface 108 and the side surface 112 on the flexible finger 104.

The one piece, integrally molded actuator 24 includes a light pipe 114 (FIG. 4). The light pipe 114 (FIG. 4) has a cylindrical central conduit 116 through which light from a light source (not shown) on the printed circuit board 34 is conducted. The light conducted through the light pipe 114 is effective to illuminate an end panel or cap 120 (FIG. 1) on the upper (as viewed in FIG. 1) end of the actuator 24. Although only a portion of the end panel 120 has been illustrated in FIG. 1, it should be understood that the end panel extends across the entire upper end of the actuator 24 and across the light pipe 114.

The one piece, integrally molded bezel 22 is provided with a plurality of legs 124, 126, 128 and 130 (FIG. 3) which extend downward (as viewed in FIG. 1). The legs 124-130 are connected with the circuit board 34 by suitable fasteners 135 (FIG. 2). In the specific embodiment illustrated in FIG. 2, the fasteners 135 are screws. It is contemplated that the bezel 22 may be connected with the circuit board 34 using fasteners other than screws. For example, a circuit board may be provided with upwardly extending projections which are received in openings in the legs 124-130. Alternatively, fasteners at the lower ends (as viewed in FIG. 1) of the legs 124-130 may be received in openings formed in the circuit board 34.

Figure 6:
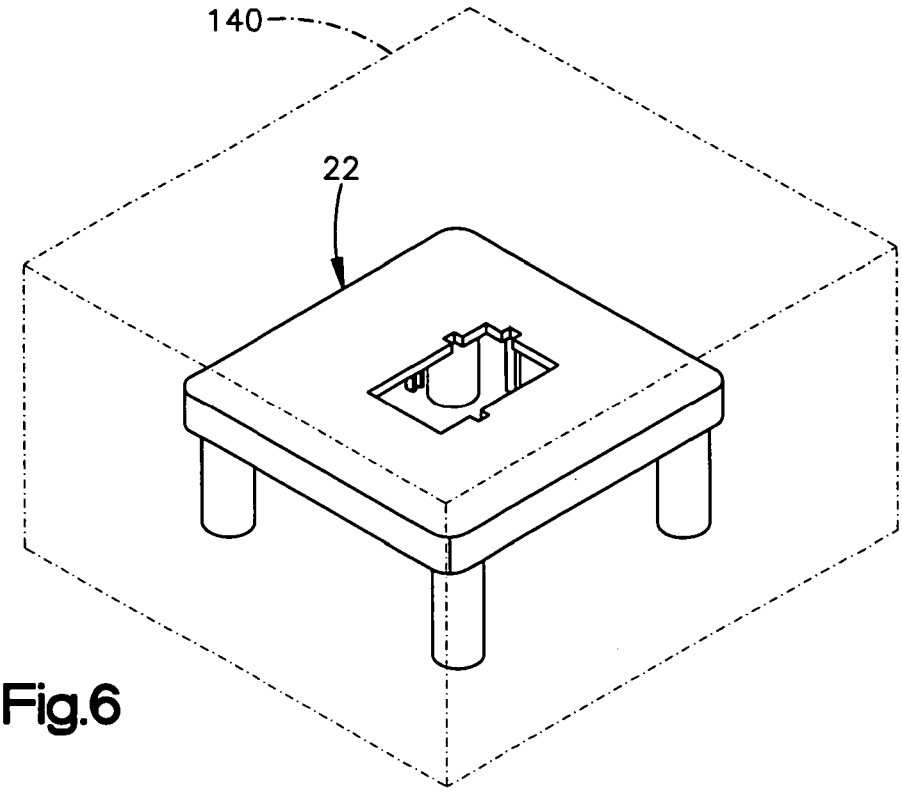
FIG. 6 is a schematic pictorial illustration depicting the manner in which the bezel is formed in a mold assembly.
Figure 7:
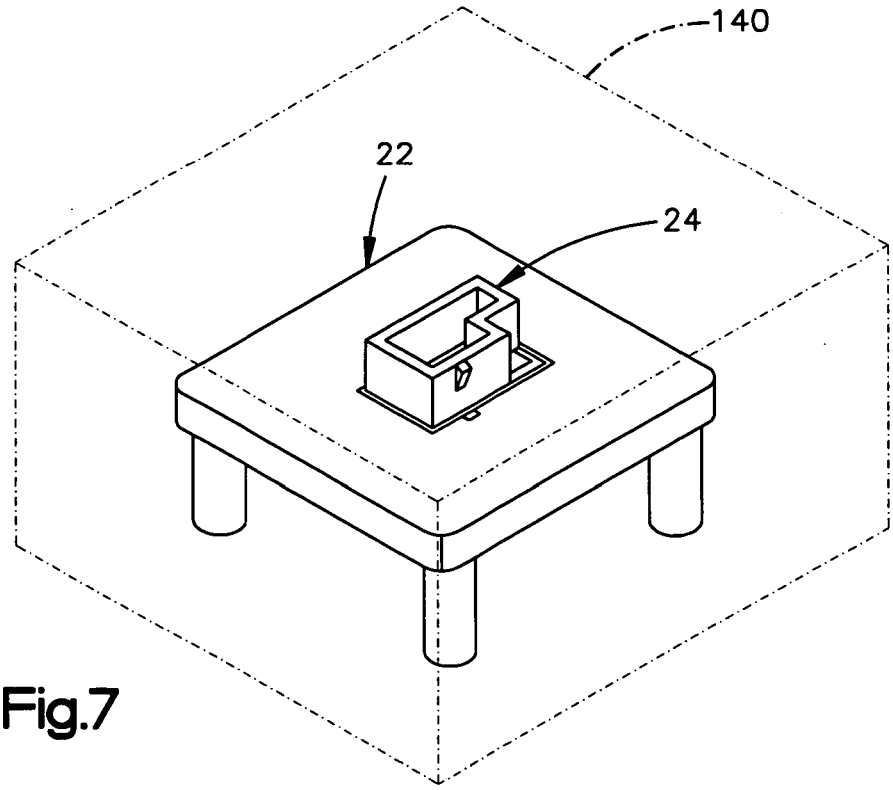
FIG. 7 is a schematic pictorial illustration, generally similar to FIG. 6, depicting the manner in which the actuator is formed in the bezel with the mold assembly of FIG. 6.

The actuator 24 and bezel 22 are formed using in-mold assembly technology in the manner illustrated schematically in FIGS. 6 and 7. A mold assembly 140 has a cavity in which the bezel 22 is injection molded in the manner illustrated schematically in FIG. 6.

Once the bezel 22 has been molded, components of the mold assembly 140 are adjusted to provide a cavity corresponding to the configuration of the actuator 24. The bezel 22 extends around the cavity corresponding to the configuration of the actuator 24. This enables the actuator 24 to be injection molded to a desired configuration by components of the mold assembly and by engagement with the previously molded bezel 22. Injection molding of the actuator 24 in the central opening in the bezel results in the bezel and actuator being assembled in the mold assembly 140 in the manner illustrated schematically in FIG. 7. The bezel 22 and actuator 24 are removed together, as a unit, from the mold assembly 140. Therefore, there is no subsequent assembly of the bezel 22 and actuator 24 after they have been removed from the mold assembly 140.

The actuator 24 may advantageously be formed of a plastic (polymeric) material having a melting temperature which is lower than the melting temperature of a plastic (polymeric) material forming the bezel 22. For example, the bezel 22 may be formed of polycarbonate/acrylonitrile butadiene styrene while the actuator 22 is formed of an acetal. Of course, different plastic (polymeric) materials may be utilized to form the actuator 24 and bezel 22 if desired.

The mold assembly 140 may be of the multi-shot injection mold type. Although the bezel 22 has been described herein as being formed before the actuator 24, it is contemplated that the actuator may be formed first and the bezel subsequently molded around the actuator. If this is done, surface areas on the bezel 22 would be shaped by engagement with surface areas on the actuator 24.

Only a single actuator 24 is associated with the bezel 22 in the embodiment of the invention illustrated in FIGS. 1-7. In the embodiment of the invention illustrated in FIGS. 8 and 9 a plurality of actuators are associated with a bezel. Each of the actuators in the embodiment of the invention illustrated in FIGS. 8 and 9 has a construction which is the same as the construction of the actuator 24 of FIGS. 1-7. The actuators of the embodiment of the invention illustrated in FIGS. 8 and 9 cooperate with a bezel in the same manner as previously described in conjunction with the embodiment of the invention illustrated in FIGS. 1-7.

Figure 8:
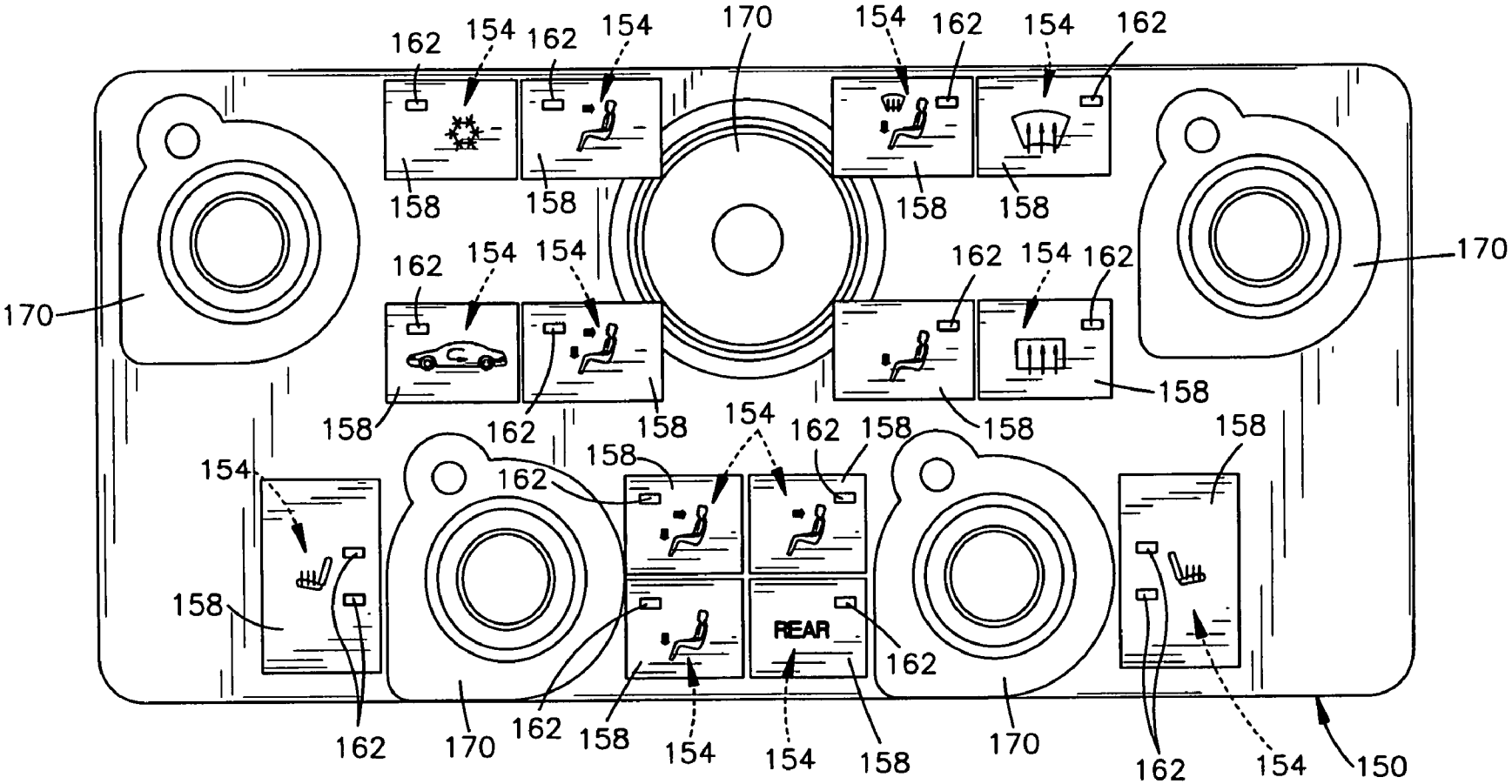
FIG. 8 is an embodiment of an actuator and bezel assembly having a plurality of actuators associated with a single bezel.
Figure 9:
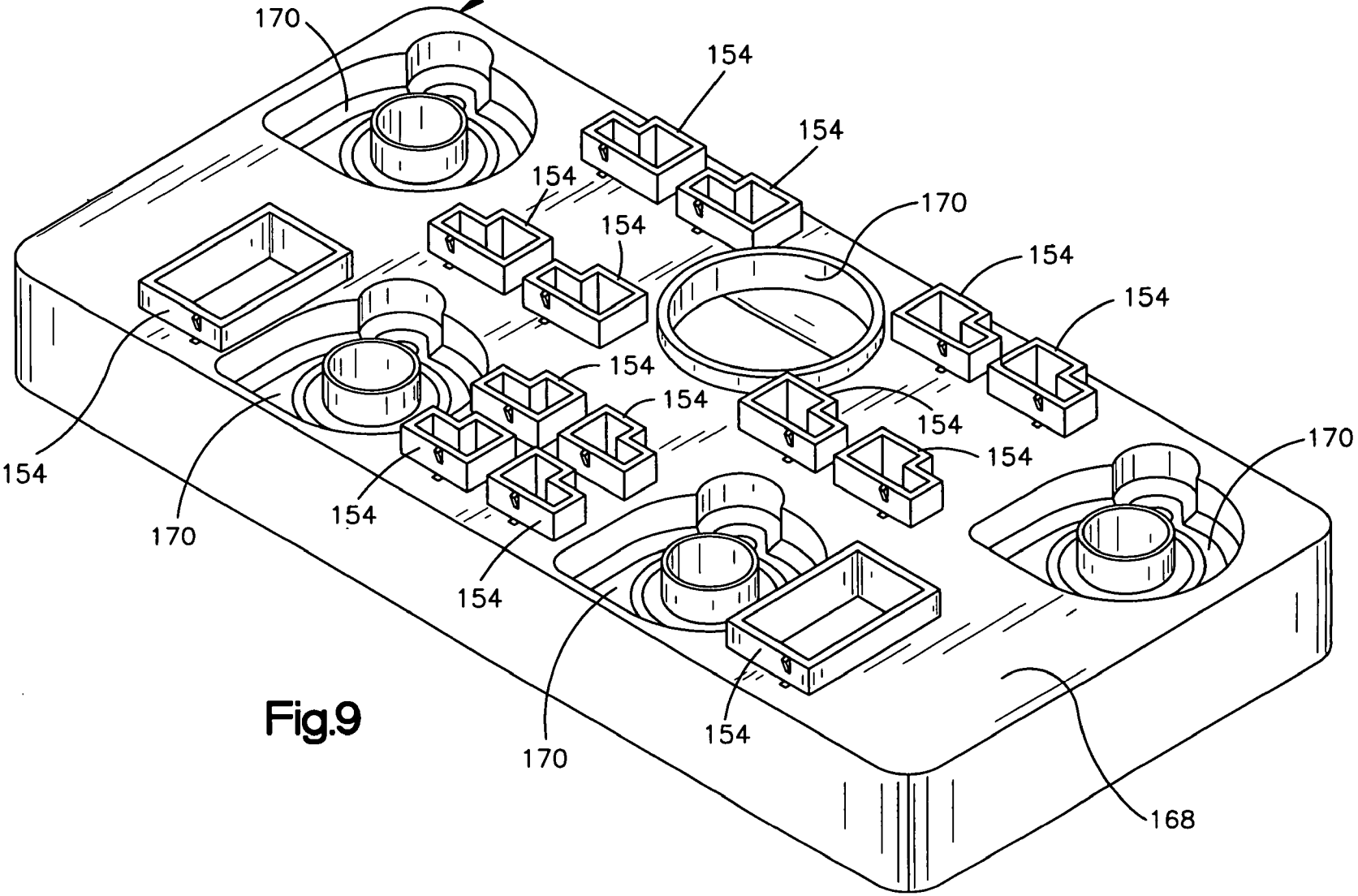
FIG. 9 is a simplified schematic pictorial illustration of the bezel and actuator assembly of FIG. 8 and further illustrating the relationship of the actuators to the bezel.

In the embodiment of the invention illustrated in FIGS. 8-9, a bezel 150 is intended to be mounted on the dashboard of an automotive vehicle. Actuators 154 are individually manually actuatable to effect operation of vehicle heating, air conditioning and ventilation controls. In addition, the actuators 154 (FIG. 8) control the operation of heated seats in the vehicle. The actuators 154 have end panels or caps 158 corresponding to the end panel 120 of FIG. 1. Indicia is provided on the end panels 158 (FIG. 8) to indicate the various functions which are to be controlled by operation of the actuators 154.

When the actuators 154 are manually pressed, that is, moved toward the bezel 150, switches disposed in the dashboard behind the bezel 150 are actuated. The switches control the function which is indicated by the indicia on the end panel 158 of each of the actuators. The end panels 158 are provided with transparent sections or windows 162 which are aligned with light pipes in the actuators 154. The actuator light pipes have the same construction as the light pipe 114 of the embodiment of the invention illustrated in FIGS. 3 and 4.

A separate light source is provided in association with the light pipe for each of the actuators 154. When the actuator 154 is moved along a linear path relative to the bezel 150 to actuate an associated switch, the light source for the actuator is energized so that light is transmitted through the light pipe of the actuator to the transparent section 162 of the end panel 158 for the actuator.

The actuators 154 are illustrated in FIG. 9 with the end panels 158 removed. The actuators 154 reciprocate along linear paths which extend perpendicular to a flat upper (as viewed in FIG. 9) side surface 168 of the bezel 150. Recesses 170 are provided in the bezel 150 to receive rotary knobs or other control elements. Thus, both rotary and linearly movable actuators are associated with the bezel 150. The actuators 154 are movable linearly and the knobs associated with the recesses 170 are rotatable relative to the bezel.

The bezel 150 and actuators 154 of FIGS. 8 and 9 are formed using in-mold assembly technology in the same manner as previously described in connection with the embodiment of the invention illustrated in FIGS. 1-7. The bezel 150 is molded in a mold cavity having a configuration corresponding to the desired configuration of the bezel. The actuators 154 are subsequently molded in a mold assembly with the actuators in the same spatial relationship as is illustrated in FIGS. 8 and 9. Components of the mold assembly are then moved to form actuator mold cavities aligned with the bezel 150.

The actuator mold cavities are filled with plastic (polymeric) material having a melting temperature which is lower than the melting temperature of the plastic (polymeric) material forming bezel 150. The plastic material of the actuator 154 is molded against surfaces on the bezel 150 in the same manner as previously described in conjunction with the embodiment of the invention illustrated in FIGS. 1-7.

From the above description of the invention, those skilled in the art will perceive improvements, changes and modifications. Such improvements, changes and modifications within the skill of the art are intended to be covered by the appended claims.

Having described the invention, the following is claimed:

1. An assembly comprising:

an actuator for actuating a control device, said actuator formed from a first plastic material and having a guide surface;

a bezel formed from a second plastic material that is different than said first plastic material, said bezel including a guide surface which engages said guide surface on said actuator; wherein a first one of said guide surface on said bezel and said guide surface on said actuator is molded against said guide surface on a second one of said guide surface on said bezel and said guide surface on said actuator such that, as molded, said actuator is allowed to move with respect to said bezel and be guided by said guide surface on said bezel; and wherein the first plastic material and the second plastic material have chemical properties which prevent the first and second plastic materials from bonding to each other during molding of one of the plastic materials against another the plastic materials.

2. The assembly of claim 1 wherein said actuator is movable linearly with respect to said bezel.

3. The assembly of claim 1 wherein said bezel includes a flexible element that cooperates with said actuator to prevent said actuator from disassembling from said bezel.

4. The assembly of claim 3 wherein said actuator extends through an opening in said bezel, said flexible element having a portion extending towards said actuator at a predetermined angle with respect to a longitudinal axis of said flexible element.

5. The assembly of claim 4 wherein a portion of said flexible element is parallel to the axis of movement of said actuator.

6. The assembly of claim 4 wherein said predetermined angle ranges from five to seven degrees.

7. The assembly of claim 1 wherein one of the plastic materials has a lower melting point than another of the plastic materials.

8. The assembly of claim 1 wherein at least one of said first and second plastic materials shrinks when cooling to form clearance spaces between said actuator and said bezel.

9. The assembly of claim 1 wherein said actuator includes a guide member on which said actuator guide surface is disposed, said bezel includes a guide post on which said bezel guide surface is disposed.

10. The assembly of claim 9 wherein at least one of said first and second plastic materials shrinks when cooling to form clearance space between said guide member and guide post.

11. The assembly of claim 1 wherein said guide surface of said actuator is molded against said guide surface of said bezel thereby eliminating movement, noise, and rattling when said actuator is in an unactuated position.

12. The assembly of claim 1 wherein said guide surface of said bezel is molded against said guide surface of said actuator such that said bezel inherently has guide surfaces parallel to guide surfaces of said actuator.

* * * * *

UNITED STATES PATENT AND TRADEMARK OFFICE

CERTIFICATE OF CORRECTION

PATENT NO. : 7,592,559 B2
APPLICATION NO. : 11/116747
DATED : September 22, 2009
INVENTOR(S) : Thomas E. Blake, III It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 291 days.

Signed and Sealed this

Twenty-first Day of September, 2010

David J. Kappos

David J. Kappos
*Director of the United States Patent and Trademark Office*